US010100468B2

(12) United States Patent
Henke

(10) Patent No.: US 10,100,468 B2
(45) Date of Patent: Oct. 16, 2018

(54) TAMPER TOOL AND ASSOCIATED HOLDER

(71) Applicant: NORDCO INC., Oak Creek, WI (US)

(72) Inventor: Daniel Mark Henke, Hartland, WI (US)

(73) Assignee: NORDCO INC., Oak Creek, WI (US)

( * ) Notice: Subject to any disclaimer, the term of this patent is extended or adjusted under 35 U.S.C. 154(b) by 98 days.

(21) Appl. No.: 15/210,562

(22) Filed: Jul. 14, 2016

(65) Prior Publication Data

US 2017/0044723 A1 Feb. 16, 2017

Related U.S. Application Data

(60) Provisional application No. 62/203,108, filed on Aug. 10, 2015.

(51) Int. Cl.
*E01B 27/16* (2006.01)

(52) U.S. Cl.
CPC ..... *E01B 27/16* (2013.01); *E01B 2203/12* (2013.01)

(58) Field of Classification Search
CPC ..... E01B 27/16; E01B 27/17; E01B 27/18; E01B 27/20
See application file for complete search history.

(56) References Cited

U.S. PATENT DOCUMENTS 5,125,145 A * 6/1992 Williams ..... B25B 27/026 29/252
5,515,788 A 5/1996 Theurer et al.
5,533,455 A * 7/1996 Theurer ..... E01B 27/16 62/155
5,584,248 A * 12/1996 Sandsted ..... E01B 27/16 104/12
5,730,059 A 3/1998 Sandsted et al.
6,067,910 A * 5/2000 Theurer ..... E01B 27/16 104/10
6,386,114 B1 * 5/2002 Morgan ..... E01B 27/16 104/10
6,877,931 B2 * 4/2005 Theurer ..... E01B 27/16 104/10
6,925,940 B2 * 8/2005 Ruban ..... E01B 27/16 104/10
6,968,786 B2 * 11/2005 Theurer ..... E01B 27/16 104/12
6,978,718 B2 12/2005 Seyrlehner
(Continued)

*Primary Examiner* — Jason C Smith
(74) *Attorney, Agent, or Firm* — Greer, Burns & Crain, Ltd.

(57) ABSTRACT

A tamper tool is provided for use in adjusting railroad ballast and constructed and arranged for use with a tamper tool holder attached to a railroad tamping machine. Included on the tool is a shaft with a first portion, a second portion, and a central portion disposed between the first and second portions, and a front surface, a rear surface, and two side surfaces. The first portion has through bores extending from the front surface to the rear surface, and the central portion has a first cross-section at an upper end, a second cross-section at a lower end. An area of the first cross-section is greater than an area of the second cross-section, and the shaft tapers between the first cross-section and the second cross-section. A paddle for tamping is attached at a free end of the second portion.

7 Claims, 3 Drawing Sheets

(56) References Cited

U.S. PATENT DOCUMENTS

| | | | | |
|---|---|---|---|---|
| 7,013,812 | B2 * | 3/2006 | Williams | E01B 27/16 104/10 |
| 7,325,496 | B2 | 2/2008 | Williams | |
| 7,527,452 | B2 * | 5/2009 | Theurer | E01B 27/16 104/10 |
| 7,726,246 | B2 | 6/2010 | Williams | |
| D789,994 | S * | 6/2017 | Henke | D15/29 |
| 9,771,690 | B2 * | 9/2017 | Henke | E01B 29/26 |
| 2002/0051682 | A1 * | 5/2002 | Gevik | E01B 27/16 404/133.05 |
| 2006/0090666 | A1 * | 5/2006 | Theurer | E01B 27/16 104/12 |
| 2010/0064928 | A1 * | 3/2010 | Theurer | E01B 27/16 104/10 |
| 2013/0263755 | A1 * | 10/2013 | Widlroither | E01B 27/14 104/13 |
| 2013/0327241 | A1 * | 12/2013 | Theurer | E01B 27/13 104/10 |
| 2015/0053449 | A1 * | 2/2015 | Henke | E01B 29/26 173/128 |
| 2017/0044723 | A1 * | 2/2017 | Henke | E01B 27/16 |

* cited by examiner

TAMPER TOOL AND ASSOCIATED HOLDER

RELATED APPLICATION

This application claims priority under 35 USC 119 from U.S. Provisional Application Ser. No. 62/203,108 filed Aug. 10, 2015.

BACKGROUND

The present invention relates to a tamper tool on a tamping machine used in railroad maintenance. Tamping machines are designed to rearrange track ballast underneath railroad ties, thus leveling the rails after right of way maintenance operations, including but not limited to tie replacement, tie plate replacement, rail replacement and the like. These machines have become a staple of railroad construction and maintenance, creating a smoother track for trains and allowing for more reliable railroad infrastructure. Suitable examples of tamper machines are found in U.S. Pat. Nos. 5,515,788; 6,386,114; and 5,584,248; all of which are incorporated by reference.

Traditionally, tamping machines are self-propelled for movement along the track, and are provided with several powered tamper drive workheads. The workheads are typically powered by hydraulic motors and include multiple eccentric drive mechanisms well known in the art. A plurality of tamper tools is attached to the workhead, and are manipulated by an operator to penetrate and distribute the ballast. The tamper tools attached to the hydraulic motors are often susceptible to wear, as they are subject to prolonged contact with hard ballast during normal use. Tamper tools may be replaced, however the changing of the tamper tool is often difficult and time consuming.

There is a need in the industry for an improved tamper tool and system for attaching the tool to the workhead.

SUMMARY

The above-listed needs are met or exceeded by the present tamper tool and tool holder which are constructed and arranged for improved performance compared to conventional devices. The present tamper tool is securely retained to the holder to prevent relative axial rotation during tamping, yet is easily removed from the corresponding holder for repair or replacement. Specialized seats on the holder retain a corresponding upper end of the tamper tool to prevent relative axial rotation of the tool during tamping. Only two fasteners extending transversely to a longitudinal axis of the tool are needed to retain the tool in the corresponding seat. In addition, the tamper tool has a specially configured profile to resist operational stresses and thus provide a relatively long operational life.

More specifically, a tamper tool is provided for use in adjusting railroad ballast and constructed and arranged for use with a tamper tool holder attached to a railroad tamping machine. Included on the tool is a shaft with a first portion, a second portion, and a central portion disposed between the first and second portions, and a front surface, a rear surface, and two side surfaces. The first portion has through bores extending from the front surface to the rear surface, and the central portion has a first cross-section at an upper end, a second cross-section at a lower end. An area of the first cross-section is greater than an area of the second cross-section, and the shaft tapers between the first cross-section and the second cross-section. A paddle for tamping is attached at a free end of the second portion.

In another embodiment, a holder is provided that is configured for use with a tamper tool on a railroad tamping machine. The holder has a general planar body with a first surface, a second surface, and a pair of side edges. A mounting point, with a bore is located on the first surface between the side edges. Each side edge has a lip, projecting generally transversely relative to the first surface, thus forming a "U"-shape with the mounting point. A seat is thus defined for receiving the shaft of the tamper tool.

In another embodiment a combination of a tamper tool and tamper tool holder is provided. The tamper tool has a shaft with a first portion, second portion, and a central portion disposed between the first and second portions. In addition, the shaft also has a front surface, rear surface, and two side surfaces. Through bores extend from the front surface to the rear surface. The tamper tool holder has a generally planar body with a first surface, second surface, a pair of side edges, and a mounting point with a bore disposed on the first surface between the side edges. Each side edge has a lip projecting generally transversely relative to the first surface, thus forming a general "U"-shape with the mounting point, thus creating a seat for receiving the shaft of the tamper tool. The seat is constructed and arranged for receiving the first portion of the tamper tool shaft in a non-rotating relationship. Since the first surface of the tool holder has a plurality mounting holes, and when assembled, the through bores of the first portion of the tamper tool and the mounting holes of the first surface holder are combined where the mounting holes and through bores are in registry. At least one fastener secures the tamper tool to the tool holder using the through bores.

DETAILED DESCRIPTION

Figure 5:
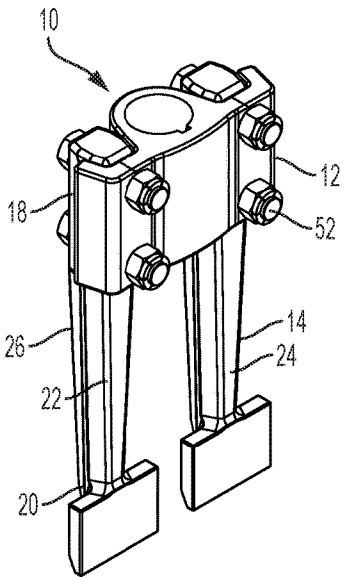
FIG. 5 is a top perspective front view of the combination of FIG. 1.

Referring now to FIGS. 1-5 and 11-16, a tamper assembly is generally designated 10 and includes a tamper tool holder 12, and at least one and preferably two tamper tools 14. In the preferred embodiment, the tamper tool 14 has a shaft 16 with a first portion 18, a second portion 20, and a central portion 22 located between the first and second portions.

Figure 6:
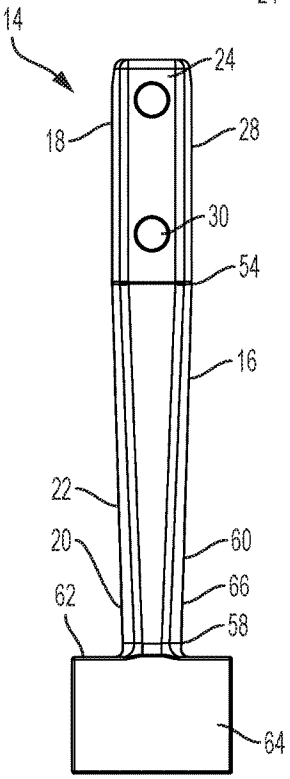
FIG. 6 is a front elevation view of the present tamper tool.
Figure 11:
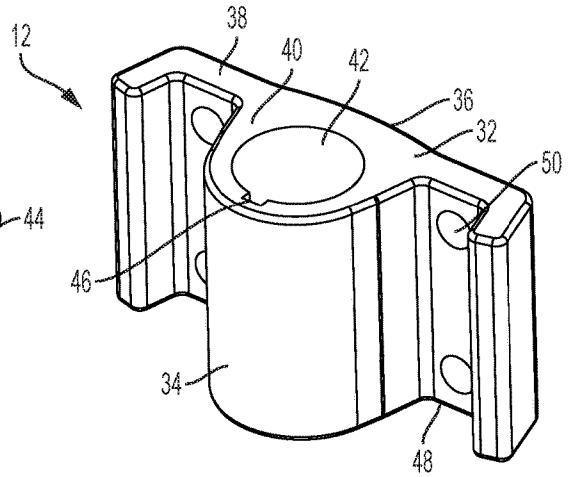
FIG. 11 is a rear perspective view of the present tamper tool holder.
Figure 12:
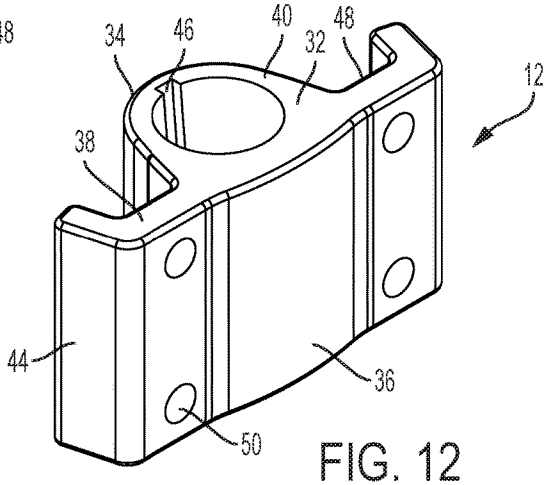
FIG. 12 is a front perspective view of the holder of FIG. 11.
Figure 13:
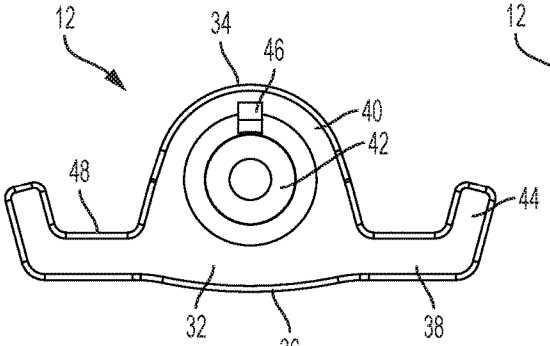
FIG. 13 is a top view of the holder of FIG. 11.
Figure 14:
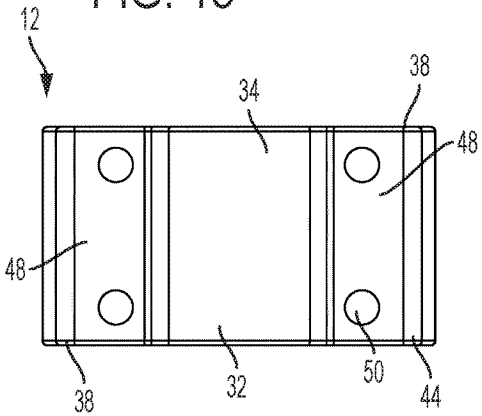
FIG. 14 is a rear elevation of the present tamper tool holder.
Figure 15:
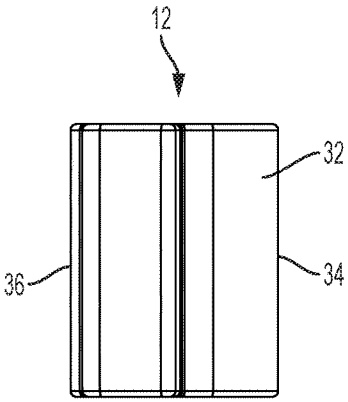
FIG. 15 is a side elevation of the present tamper tool holder.
Figure 16:
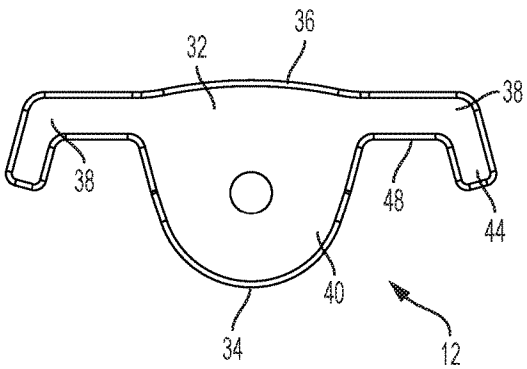
FIG. 16 is a bottom view of the present tamper tool holder.

Also included on the shaft is a front surface 24, a rear surface 26, and two side surfaces 28. The first portion 18 has through bores 30 (FIG. 6) extending from the front surface 24 to the rear surface 26.

Figure 4:
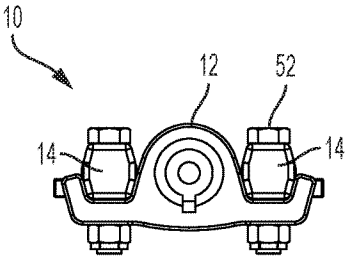
FIG. 4 is a top view of same.
Figure 3:
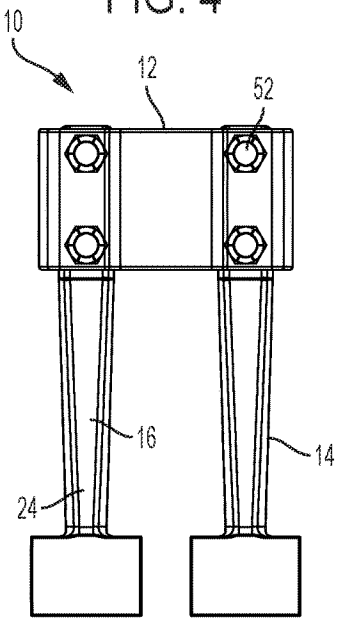
FIG. 3 is a front elevation of the combination of FIG. 1.
Figure 2:
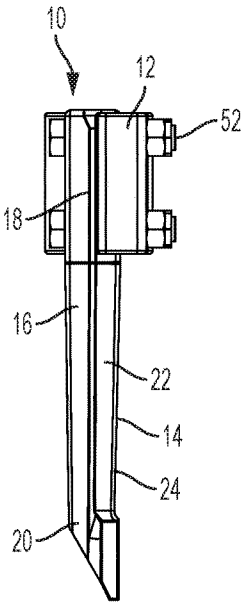
FIG. 2 is a left side view of the combination of FIG. 1.
Figure 1:
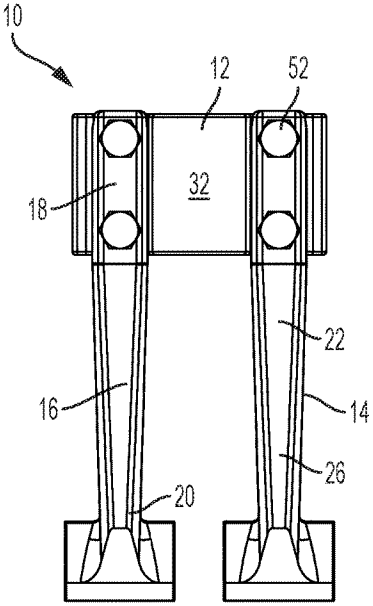
FIG. 1 is a rear elevation view of the present combination tamper tool and holder.
Figure 9:
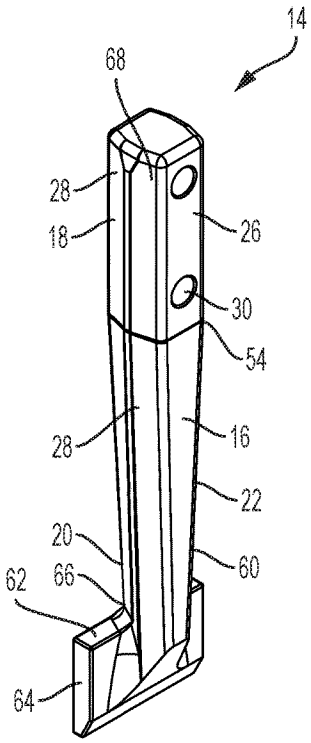
FIG. 9 is a rear perspective view of the present tamper tool.
Figure 8:
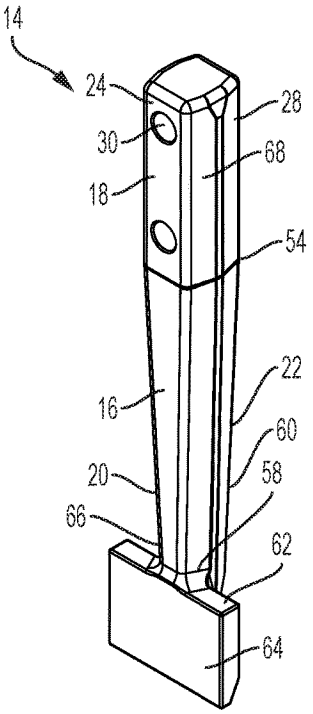
FIG. 8 is a front perspective view of the present tamper tool.
Figure 7:
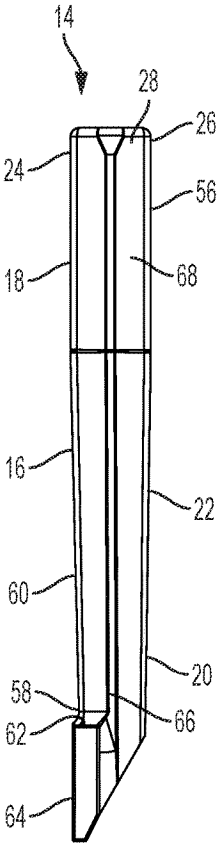
FIG. 7 is a right side view of FIG. 6.

Configured for retaining the tamper tool 14 so that axial rotation is prevented during tamping, the tamper tool holder 12 includes a generally planar body 32 having a first surface 34, a second surface 36 opposite the first surface, and a pair of side edges 38. A mounting point 40 with a bore 42 is disposed on the first surface 34 between the side edges 38. The bore 42 is constructed and arranged with a tapered configuration and a keyway 46 for receiving a tamper workhead drive shaft (not shown). Each side edge 38 has a lip 44 projecting generally transversely relative to the first surface 34, forming a "U"-shape with the mounting point 40 when viewed from above (FIG. 4). This "U"-shape defines a seat 48 for receiving the first portion 18 of the tamper tool shaft 16 in a non-rotating relationship. A pair of such seats 48 are provided in the holder 12, one on each side of the mounting point 40 so that two tools 14 are accommodated in spaced, parallel relationship to each other. The body 32 has a plurality of mounting holes 50. Upon assembly of the tamper assembly 10, the mounting holes 50 of the holder 12 and the through bores 30 of the shaft 16 are in registry. At least one and preferably two fasteners 52 secure each tamper tool 14 to the holder 12 using the through bores 30 and the mounting holes 50. Thus, the fasteners 52 extend in a direction transverse to a longitudinal axis of the tool 14. In the preferred embodiment, the fastener 52 is a nut and bolt, however other suitable fasteners used in the rail maintenance industry are contemplated, including pins with retaining clips and the like.

Referring now to FIGS. 6-10, the shaft 16 of the tamper tool 14 also has the central portion 22, which is defined by a first cross-section 54 at an upper end 56 located below a lowermost through bore 30, a second cross-section 58 at a lower end 60, adjacent an upper edge 62 of a paddle 64. In the preferred embodiment, an area of the first cross-section 54 is greater than an area of the second cross section 58. In other words, the tamper tool shaft 16 tapers between the first cross-section 54 and the second cross section 58. This tapered configuration of the shaft 16 is visible from the front and rear surfaces 24, 26, as well as from the side surface 28 (FIGS. 6-9). The paddle 64 is integrally attached at a free end 66 of the second portion 20 of the tamper tool shaft 16.

Figure 10:
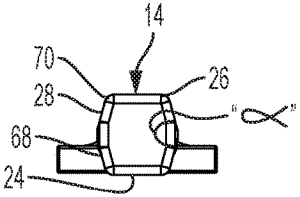
FIG. 10 is a top view of the present tamper tool.

Referring now to FIG. 10, it is preferred that the tamper tool shaft 16 is hexagonal in transverse cross-section defined by side surfaces 28. The side surfaces 28 have facets 68 extending transverse to an axis of the shaft 16, and each facet is preferably disposed at an obtuse angle "a" relative to each other. The angle "a" is defined between the two facets 68. It is also contemplated that "a" may be at a right angle. It is also preferred that the shaft 16 has radiused corners 70 at junctions of the front 24 and rear 26 surfaces with respective side surfaces 28.

While a particular embodiment of the present tamper tool and associated holder has been described herein, it will be appreciated by those skilled in the art that changes and modifications may be made thereto without departing from the invention in its broader aspects and as set forth in the following claims.

The invention claimed is:

1. A holder configured for use with a tamper tool on a railroad tamping machine, comprising:

a generally planar body having a first surface, a second surface, and a pair of side edges;

a mounting point with a bore disposed on said first surface between said side edges;

each said side edge having a lip projecting generally transversely relative to said first surface, each said lip forming a general "U"-shape with said mounting point, and defining a seat for receiving a shaft of the tamper tool, the shaft having a plurality of facets disposed at obtuse angles relative to each other, wherein at least one of said facets abuts said lip, and wherein at least one of said facets abuts said mounting point, and wherein said shaft abuts said first surface, such that said holder engages the shaft in a non-rotating relationship; and said first surface has a plurality of mounting holes projecting normally to said seat for receiving at least one fastener securing said holder to the tamper tool using said mounting holes, the mounting holes being constructed and arranged so that the at least one fastener projects normally to said seat so that each tool is secured to said holder in said seat only by the at least one fastener and engagement between the shaft and said seat.

2. The holder of claim 1, wherein the bore is tapered.

3. The holder of claim 1, wherein the bore is keyed.

4. The holder of claim 1, wherein the seat comers are radiused.

5. A combination of a tamper tool and a tamper tool holder for use in a railroad maintenance machine, comprising:

a tamper tool, having a shaft with a first portion, a second portion, and a central portion disposed between said first and second portions, and a front surface, a rear surface, and two side surfaces;

said first portion having through bores extending from the front surface to the rear surface;

a tamper tool holder having a generally planar body having a first surface, a second surface, and a pair of side edges;

said tamper tool holder having a mounting point with a bore disposed on said first surface between said side edges;

each said side edge having a lip projecting generally transversely relative to said first surface, each said lip forming a general "U"-shape with said mounting point, and defining a seat for receiving said shaft of said tamper tool;

said first surface has a plurality of mounting holes;

said two side surfaces are faceted, said facets extending transverse to an axis of said shaft and each said facet disposed at an obtuse angle relative to the other, such that said facets are received by said seat of said holder;

said seat is constructed and arranged for receiving said first portion of said tamper tool shaft, wherein at least one of said facets abuts said lip, and wherein at least one of said facets abuts said mounting point, and wherein said shaft abuts said first surface at the front surface of said shaft, such that said seat receives said first portion of said tamper tool shaft in a non-rotating relationship;

said mounting holes of said first surface and said through bores of said first portion are in registry; and at least one fastener securing said holder to said tamper tool using the through bores and projecting normally to said seat so that each said tool is secured to said tool holder in said corresponding seat only by said at least one fastener and engagement between said shaft and said seat.

6. The combination of claim 5 wherein said tool holder includes a pair of said seats for accommodating a pair of said tools in spaced, parallel relationship to each other.

7. The combination of claim 5 wherein said at least one fastener projects transversely to a longitudinal axis of said shaft.

* * * * *